US007736245B2

(12) United States Patent
Hasegawa

(10) Patent No.: US 7,736,245 B2
(45) Date of Patent: Jun. 15, 2010

(54) GOLF CLUB SHAFT AND GOLF CLUB

(75) Inventor: Hiroshi Hasegawa, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/797,855

(22) Filed: May 8, 2007

(65) Prior Publication Data

US 2007/0298902 A1 Dec. 27, 2007

(30) Foreign Application Priority Data

Jun. 27, 2006 (JP) ..... 2006-176961

(51) Int. Cl.
*A63B 53/10* (2006.01)

(52) U.S. Cl. ..... 473/319

(58) Field of Classification Search ..... 473/319
See application file for complete search history.

(56) References Cited

U.S. PATENT DOCUMENTS 5,156,396 A * 10/1992 Akatsuka et al. ..... 473/319
5,439,219 A * 8/1995 Vincent ..... 473/319
5,685,783 A * 11/1997 Akatsuka et al. ..... 473/319
6,273,830 B1 * 8/2001 Takemura et al. ..... 473/319
7,297,070 B2 * 11/2007 Ashida et al. ..... 473/223

FOREIGN PATENT DOCUMENTS

JP 2002-253714 A 9/2002

* cited by examiner

*Primary Examiner*—Stephen L. Blau
(74) *Attorney, Agent, or Firm*—Birch, Stewart, Kolasch & Birch, LLP

(57) ABSTRACT

A golf club shaft 2 made of a fiber-reinforced resin having a weight W of 30 to 55 g calculated as a shaft having a length of 46 inches and an average flexural rigidity EIa of 1.5 to 4.0 kgf·m$^2$ and satisfying the equation: EIa≧0.1W−1.5. Since it is light weight but has a relatively high flexural rigidity, a golf club can be swung at high speed without deteriorating the flight direction performance.

10 Claims, 5 Drawing Sheets

GOLF CLUB SHAFT AND GOLF CLUB

BACKGROUND OF THE INVENTION

The present invention relates to a golf club shaft capable of increasing the flight distance of a golf ball, and more particularly to a technology for increasing the flight distance of, for example, golfers having a high swing speed by increasing the rigidity of a golf club shaft while lightening the weight of the shaft.

In general, swing form and swing speed greatly vary with every golfer. Therefore, in order to increase the flight distance by optimizing the flexure of a golf club shaft with comfortable swing to thereby accelerate the swing speed of a golf club head (hereinafter referred to as "head speed"), golf club shafts must be those suited to respective golfers. Optimum flexure of a golf club shaft during swing will accelerate the head speed just before striking a golf ball and will increase the dynamic loft angle to provide an optimum angle of striking out a golf ball.

Thus, the weight, flexural rigidity and so on of a golf club shaft are set according to ability, swing form, liking, etc. of a golfer. For example, since most of professional and high class golfers have a great physical strength and a proper swing form, they tend to be able to sufficiently bend the shaft and tend to have a high swing speed. Therefore, to golf clubs for them is generally attached a shaft having a heavy weight and a high flexural rigidity. On the other hand, beginner's class and senior golfers are not able to perform a swing sufficiently utilizing a flexure of a golf club shaft and the swing speed tends to be relatively low. Therefore, in golf clubs for them, it is general to use a golf club shaft having a light weight and a low flexural rigidity. Like this, conventional golf club shafts are roughly classified into such two types of shafts, namely a heavy weight high rigidity shaft and a lightweight low rigidity shaft.

If a golfer who does not have a great physical strength but can swing a golf club at a high speed so as to bend the shaft by twisting of the upper body and body turn during swing, uses a heavy weight high rigidity shaft, the golfer cannot surely swing the club to a finish and, therefore, there arises a problem that the face of a club head does not completely return, so the flight direction of a golf ball is not stabilized. On the other hand, if the golfer uses a lightweight low rigidity shaft, frequently the direction of the face is not stabilized when striking a golf ball due to excess flexure of the shaft during the swing, so the flight direction is not stable.

In order to eliminate disadvantages of lightweight shafts such as poor flight direction performance, decrease in strength and so on, it is proposed, for example, to provide a shaft with a specific distribution of flexural rigidity or to change the flexural rigidity of a specific portion of the shaft such as a tip portion or butt portion of the shaft. On the other hand, in recent years, golf club shafts made of a fiber-reinforced resin are popularly used, since adjustment of the weight, flexural rigidity and so on of the shafts can be relatively easily conducted as compared with metal shafts. For example, JP-A-2002-253714 discloses a lightweight golf club shaft made of a fiber-reinforced resin wherein the flexural rigidity of a grip portion of the shaft is set to a specific range in order to improve the flight distance and the vibration dampening property.

It is an object of the present invention to provide a golf club shaft that even beginner's class and senior golfers can convey a swing power to a golf club head up to the maximum without changing their swing timing and can stabilize the flight direction of a golf ball.

Another object of the present invention is to provide a lightweight golf club which is suitable for golfers having a small muscular strength and a high swing speed and which has a stabilized flight direction performance.

These and other objects of the present invention will become apparent from the description hereinafter.

SUMMARY OF THE INVENTION

It has been found that an average flexural rigidity of a golf club shaft is important for lightweight shafts unlike known shafts wherein attention is paid to the flexural rigidity of a specific portion or position of the shaft.

In accordance with the present invention, there is provided a golf club shaft comprising a fiber-reinforced resin, the shaft having a weight W of 30 to 55 g calculated as a shaft having a length of 46 inches and an average flexural rigidity EIa of 1.5 to 4.0 kgf·m$^2$ and satisfying the following equation (1):

$$EIa \geqq 0.1W - 1.5 \quad (1)$$

It is preferable that the golf club shaft satisfies the following equation (2):

$$EIa \geqq 0.1W - 0.5 \quad (2)$$

especially the following equation (3):

$$EIa \geqq (1/15)W + 1.0 \quad (3)$$

Since the golf club shaft of the present invention has a weight of 30 to 55 g calculated as a shaft having a length of 46 inches, even weak-armed golfers can swing a golf club to a finish. Further, the golf club shaft of the present invention has a high average flexural rigidity EIa within the range of 1.5 to 4.0 kgf·m$^2$ and, moreover, the average flexural rigidity is set high according to the shaft weight. Since such a shaft has a sufficiently high flexural rigidity, excess flexure is suppressed to stabilize the flight direction even if the golf club is swung to a finish at a high swing speed.

DETAILED DESCRIPTION OF THE INVENTION

An embodiment of the present invention will now be explained with reference to the accompanying drawings.

Figure 1:
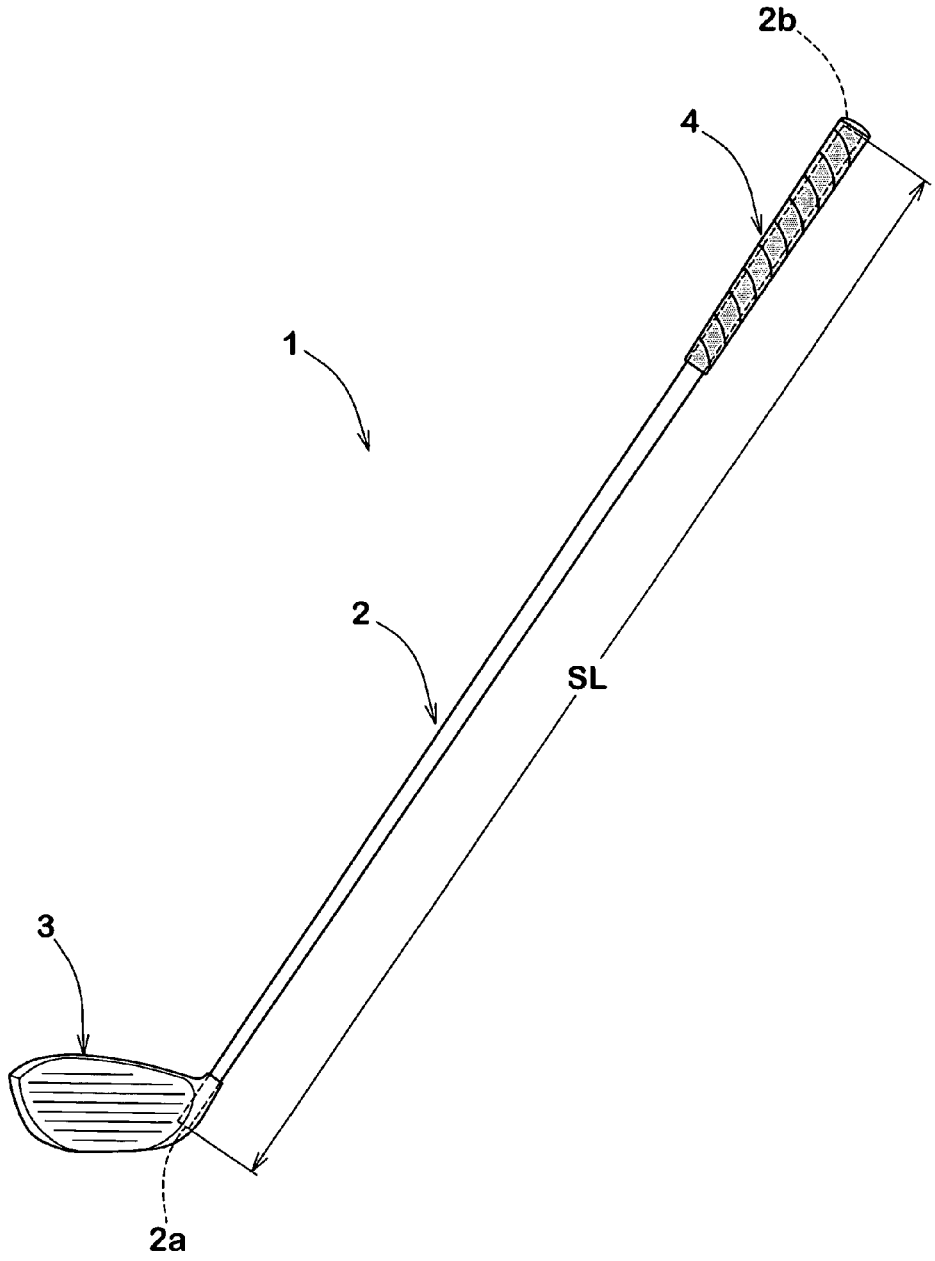
FIG. 1 is a front view of a golf club illustrating an embodiment of the present invention.

FIG. 1 is a front view of a golf club having a golf club shaft according to an embodiment of the present invention. Golf club 1 includes a shaft 2, a golf club head 3 attached to a tip 2*a* side of the shaft 2, and a grip 4 attached to a butt 2*b* side of the shaft 2. The golf club 1 shown in FIG. 1 is a wood-type golf club of driver (#1 wood), but the golf club shaft of the present invention is of course applicable to other wood-type golf clubs, e.g., spoon (#3 wood), baffy (#4 wood) and cleek (#5 wood), and iron-type golf clubs.

Known golf club heads can be used in the present invention. For example, the golf club head 3 has a hollow structure, and it comprises a hollow shell made of a metallic material such as aluminum alloy, titanium, titanium alloy or stainless steel. It is preferable that the head 3 has a volume of 300 to 470 $cm^3$ and a weight of about 180 to about 220 g. A part of the head 3 may be made of a non-metallic material such as a fiber-reinforced resin. For example, the head 3 may comprise a hollow metallic shell having at least one opening and a non-metallic cover disposed in the opening.

As a grip 4 can be used various known grips such as rubber grips, resin grips and leather grips.

The shaft 2 is made of a fiber-reinforced resin and is formed into a pipe body having a circular section and having such a tapered form that the outer diameter is decreased from the butt 2*b* toward the tip 2*a*. The shaft 2 made of a fiber-reinforced resin is particularly preferred from the viewpoints that it is light weight as compared with a steel shaft and adjustment of flexural rigidity and so on can be easily made. Such a shaft made of a fiber-reinforced resin can be readily prepared by various known methods such as a sheet winding method, a filament winding method, and an internal pressure molding method wherein a prepreg is placed in a mold and a pressure is applied to the prepreg from the inner side under heating.

Reinforcing fibers used in the fiber-reinforced resin are not particularly limited. Examples of the fiber are, for instance, an inorganic fiber such as carbon fiber, glass fiber, boron fiber, silicon carbide fiber or alumina fiber, and an organic fiber such as polyethylene fiber or polyamide fiber. Metal fibers can also be used as a reinforcing fiber. These reinforcing fibers may be used alone or in admixture thereof. Reinforcing fibers having a tensile modulus of 3 to 90 $tonf/mm^2$ are preferred from the viewpoints of lightening and improvement in strength of the shaft.

Resins used in the fiber-reinforcing resin include thermosetting resins and thermoplastic resins. Examples of the thermosetting resins are, for instance, epoxy resin, unsaturated polyester resin, phenol resin, melamine resin, urea resin, diallyl phthalate resin, polyurethane resin, polyimide resin, silicone resin and the like. Examples of the thermoplastic resins are, for instance, polyamide resin, saturated polyester resin, polycarbonate resin, polystyrene resin, polyethylene resin, polyvinyl acetate resin, AS resin, methacrylic resin, polypropylene resin, fluorine-containing resin and the like.

In the present invention, the shaft 2 has a weight within a specific range. The weight W of shaft 2 calculated as a shaft having a length of 46 inches (1168.4 mm) is set to 30 to 55 g. Here, the shaft weight W (g) calculated as a shaft having a length of 46 inches is determined according to the following equation:

$$W = Wr \times 46/SL$$

wherein SL is an actual length (inch) of shaft and Wr is an actual weight of shaft.

In case of a wood-type golf club 1, it has been often conducted to change the length of shaft according to loft angle and other specifications of the shaft. Therefore, there is not much point in specifying the shaft weight regardless of the shaft length. In the present invention, a shaft weight calculated to a weight for a length of 46 inches is used to specify the weight of the shaft 2 instead of the actual weight of shaft 2. If the shaft weight W is less than 30 g, the shaft is much lighter than conventional shafts, so a player would feel incongruity at the time of address and swing is not stabilized, resulting in deterioration of flight direction performance. Also, there is a possibility that the shaft is short of rigidity and strength. From such points of view, the shaft weight W is preferably at least 35 g. On the other hand, if the shaft weight W is more than 55 g, an arm strength according to the weight is required to swing the golf club without lowering the swing speed and, therefore, such a shaft is unsuitable for target golfers for the present invention and lowering of flight distance may occur. From such points of view, the shaft weight W is preferably at most 50 g.

For the same reasons as above, the actual weight Wr of shaft 2 used in the golf club 1 is preferably at least 25 g, more preferably at least 30 g, the most preferably at least 35 g, and is preferably at most 60 g, more preferably at most 55 g, the most preferably at most 50 g.

The actual shaft length SL is not particularly limited, but if the shaft is too short, increase in head speed based on the shaft length is not sufficiently expected, and if the shaft length is too long, the golf club is hard to be swung, resulting in lowering of head speed. From such points of view, the actual shaft length SL is preferably at least 800 mm, more preferably at least 825 mm, the most preferably at least 850 mm, and is preferably at most 1,200 mm, more preferably at most 1,175 mm, the most preferably at most 1,150 mm.

Figure 2:
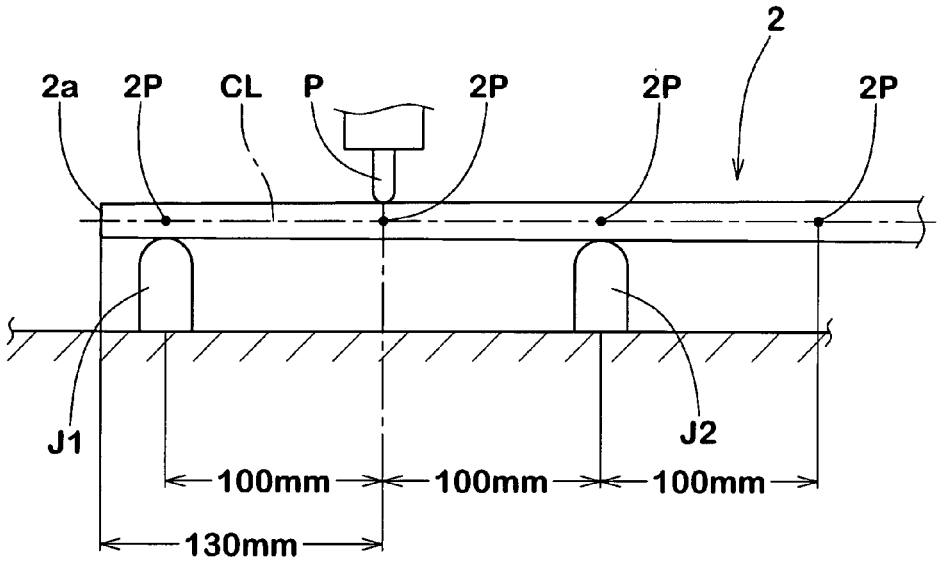
FIG. 2 is a diagram illustrating a method for measuring the flexural rigidity of a golf club shaft.

The shaft 2 of the present invention has an average flexural rigidity EIa of 1.5 to 4.0 $kgf \cdot m^2$. The term "average flexural rigidity EIa" as used herein means an average value of flexural rigidity values of a shaft 2 measured, as shown in FIG. 2, at a starting point spaced from the tip 2*a* by a distance of 130 mm and at locations apart from the starting point at intervals of 100 mm in the axial direction up to the butt 2*b*.

The flexural rigidity EI of the shaft 2 is measured using a universal testing machine by bending the shaft 2 in a three point bending manner as described below in detail. Firstly, the shaft 2 is supported by supporters J1 and J2 spaced from each other at a distance of 200 mm so that the axial center line CL of the shaft 2 is made level and a measuring point 2P is located at the middle point of the supporting span between the supporters J1 and J2. The first measuring point 2P is a point spaced from the tip 2*a* by a distance of 130 mm, and the subsequent measuring points 2P are set every 100 mm from the first measuring point 2P. An indenter P is then moved downward to the measuring point 2P at a speed of 5 mm/minute to bend the shaft 2. When a load of 20 kgf is applied to the shaft 2, the movement of the indenter P is stopped and the flexural amount of the shaft 2 at the pressing point 2P is measured. The flexural rigidity EI ($kgf \cdot m^2$) at the measuring point 2P is obtained from the following equation.

$$\text{Flexural rigidity } EI(kgf \cdot m^2) = [\text{applied load} \times (\text{distance between supporting points})^3]/(48 \times \text{flexural amount})$$

wherein the units of the distance and flexural amount are meter, and the unit of force is kgf. In the above measurement, the radius of curvature of a semispherical tip of each of the supporters J1 and J2 is 12.5 mm, and the radius of curvature of a hemispherical tip of the indenter P is 6.0 mm. When the axial distance between the measuring point 2P and the butt 2*b* of the shaft 2 becomes less than 130 mm, this measuring point is made a last measuring point on the butt 2*b* side of the shaft 2.

If the average flexural rigidity EIa is less than 1.5 $kgf \cdot m^2$, a golfer is hard to swing a golf club since the shaft excessively bends during the swing, and the flight direction performance is poor since the direction of a face of club head 3 is not stabilized. Also, a golf ball cannot be driven by a strong impact. From such points of view, the average flexural rigidity EIa of the shaft 2 is preferably at least 1.7 $kgf \cdot m^2$. On the other hand, if the average flexural rigidity EIa of the shaft 2 is more than 4.0 $kgf \cdot m^2$, the shaft 2 is not properly bent during the swing, so it is not possible to increase the head speed and the dynamic loft angle at impact. Therefore, the flight distance cannot be sufficiently increased. From such points of view, the average flexural rigidity EIa is preferably at most 3.9 kgf·m$^2$, more preferably at most 3.8 kgf·m$^2$.

The shaft 2 of the present invention is further required to satisfy the following equation (1):

$$EIa \geqq 0.1W - 1.5 \quad (1)$$

wherein EIa is the average flexural rigidity of the shaft 2, and W is the weight of the shaft 2 calculated to a weight for a length of 46 inches.

Figure 3:
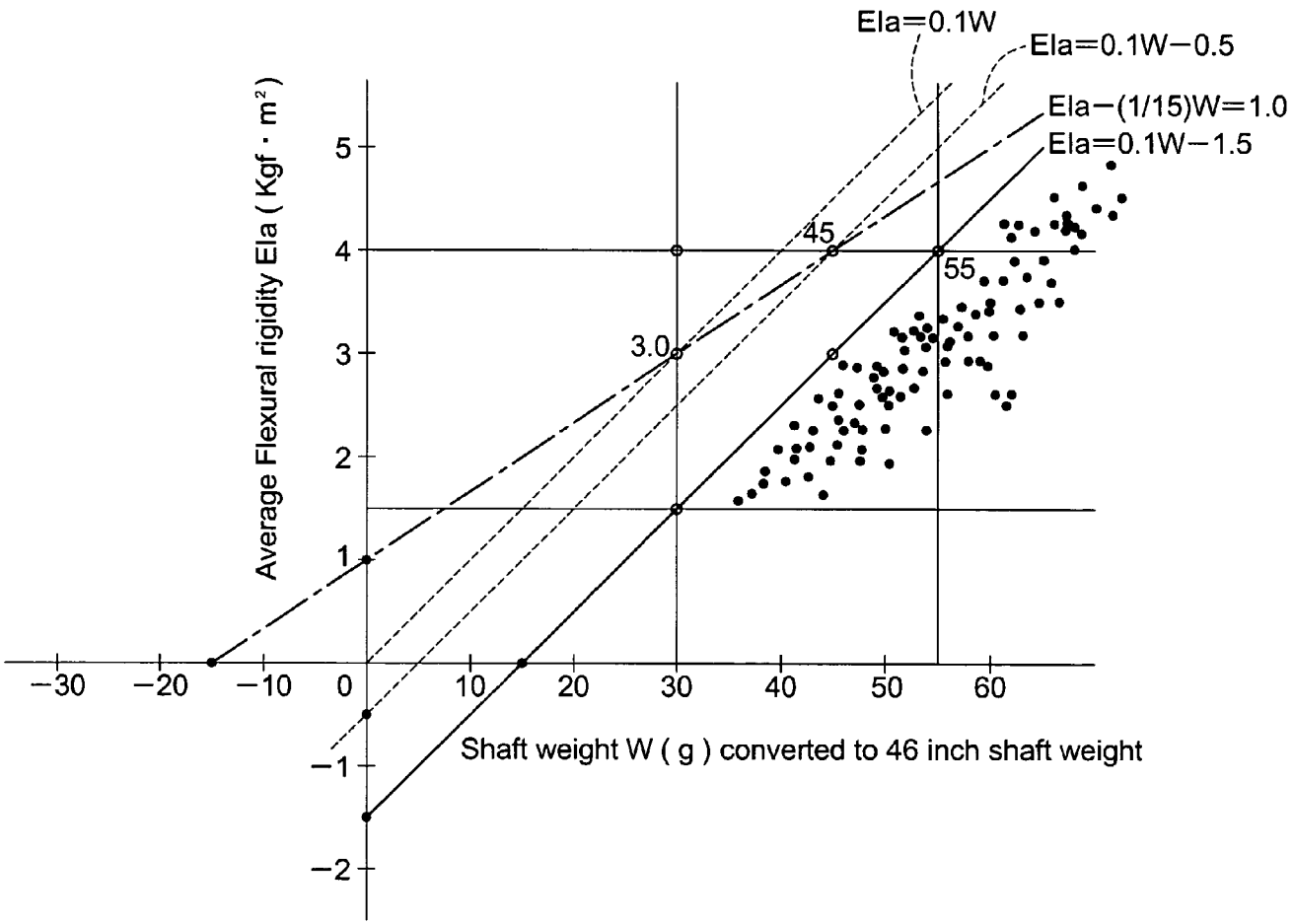
FIG. 3 is a graph showing a relationship between the weight and flexural rigidity of a golf club shaft.

FIG. 3 is a graph showing a relationship between the average flexural rigidity EIa and the shaft weight W, wherein black dots are for conventional shafts. From the results of the present inventor's investigation, it is found that conventional shafts having a small weight W are produced to have a low average flexural rigidity EIa. As stated above, such lightweight shafts having a low flexural rigidity have the disadvantage that if golfers having no large muscular strength but having a high swing speed use such a shaft, the shaft excessively bends during the swing and the direction of the face of the club head at impact is not stabilized to deteriorate the flight direction performance.

In the present invention, an optimum weight which enables to easily perform address and swing is secured by restricting the shaft weight W calculated to a weight for a length of 46 inches within a specific range, while an adequate flexure of the shaft during swing is secured by restricting the average flexural rigidity EIa of the shaft within a specific range. Furthermore, the shaft 2 of the present invention satisfies the equation (1) so that the value of the average flexural rigidity to the shaft weight is made larger as compared with those of conventional shafts, whereby golfers having no large muscular strength but having a high swing speed can swing a golf club without changing their swing timing to obtain an optimum flexure of the shaft during the swing and accordingly to improve the flight direction performance and the flight distance.

It is preferable that the shaft 2 satisfies the following equation (2):

$$EIa \geqq 0.1W - 0.5 \quad (2)$$

especially the following equation (3):

$$EIa \geqq (1/15)W + 1.0 \quad (3)$$

Shafts 2 satisfying the equation (2) can have a higher average flexural rigidity EIa than those satisfying the equation (1), and shafts 2 satisfying the equation (3) can have a higher average flexural rigidity EIa than those satisfying the equation (2).

The upper limit of the average flexural rigidity EIa of the shaft 2 is 4.0 kgf·m$^2$, but it is preferable that the shaft 2 has an average flexural rigidity satisfying the following equation (4):

$$EIa \leqq 0.1W \quad (4)$$

whereby as to a shaft having a relatively small weight of 30 to 40 g, the upper limit of the average flexural rigidity EIa is restricted so that an optimum average flexural rigidity can be selected.

Figure 4:
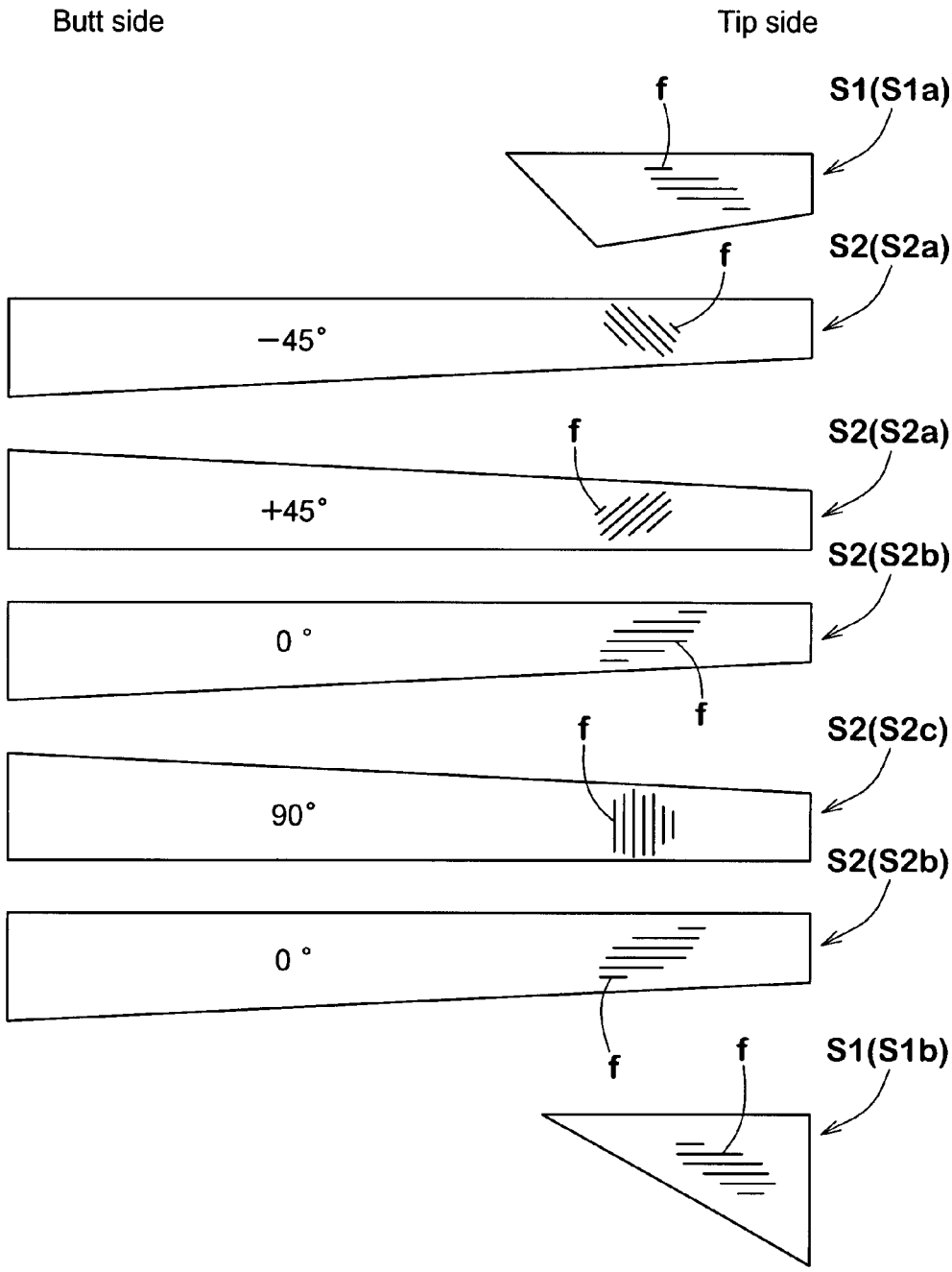
FIG. 4 shows prepregs used to prepare a golf club shaft according to the present invention.

The shaft 2 as mentioned above can be prepared, for example, by using plural kinds of prepregs S such as prepregs S1 and prepregs S2 as shown in FIG. 4.

The prepreg S is a composite sheet material in which a reinforcing fiber material "f" disposed in parallel is impregnated with an uncured resin as a matrix resin, followed by solidification. Firstly, prepregs S are wound in layers around a mandrel as a core (now shown) to form a cylindrical laminate. In FIG. 4, the prepregs S are wound in order from the top prepreg to the bottom prepreg. The mandrel is then pulled out from the cylindrical laminate, and an expandable bladder or the like is inserted into a hollow portion of the laminate. The laminate is then placed in a mold together with the bladder and cured into a prescribed shape by applying heat and pressure to the laminate, whereby the resin and the reinforcing fiber "f" are integrated to form a shaft 2 made of a fiber-reinforced resin.

The prepregs S as used in the present invention include, for instance, small sheet-like tip side prepregs S1 laminated on a tip 2*a* side portion of the shaft 2, and full length prepregs S2 constituting the full length of the shaft 2.

The tip side prepregs S1 serve to enhance the strength of the shaft 2 in addition to adjusting the rigidity in the vicinity of the tip 2*a* of the shaft. Therefore, it is preferable to laminate the tip side prepregs S1 in 1 to about 20 layers. If the tip side prepreg S1 is not used, the durability of the tip 2*a* portion of the shaft 2 tends to be lowered. If the tip side prepregs S1 are laminated in more than 20 layers, the tip portion becomes thick to form a step on the shaft, which is unfavorable since a stress is concentrated to the step. From such points of view, preferably the tip side prepregs S1 are laminated in at least two layers, and in at most 19 layers, especially at most 18 layers.

The angle of arrangement of the reinforcing fiber "f" in the tip side prepregs S1 is for example from 0 to 90° with respect to the axis of the shaft 2. In case that it is desired to increase the flexural rigidity of a tip portion of the shaft 2, the angle of arrangement of the reinforcing fiber "f" is preferably 10° or less, the most preferably 0°. In case that it is desired to enhance the torsional rigidity of the shaft 2, the angle of arrangement of the reinforcing fiber "f" is preferably from 40 to 50°, the most preferably 45°. As to the shape of the tip side prepregs S1 prior to the molding, the tip side prepregs may be a tetragonal sheet S1*a* or a triangular sheet S1*b*, as shown in FIG. 4. In view of easing a stress concentration by decreasing a step formed between a tip side prepreg laminate and a full length prepreg laminate, a triangular prepreg sheet S1*b* is preferred.

Basic properties of the shaft 2 such as flexural rigidity and strength are determined by the full length prepregs S2. Therefore, it is preferable to laminate the full length prepregs S2 in 5 to 20 layers. If the number of layers is less than 5, the rigidity and strength of the shaft 2 are lowered. If the full length prepregs S2 are laminated in more than 20 layers, owing to increase in the number of windings, the productivity is lowered and generation of voids between the layers may occur. From such points of view, the number of layers of the full length prepreg S2 is preferably at least 6 layers, more preferably at least 7 layers, and is preferably at most 19 layers, more preferably at most 18 layers.

The full length prepregs S2 include, for instance, a slant layer or prepreg S2*a* in which the reinforcing fiber "f" is arranged at an angle of 10 to 80°, preferably 20 to 70° with respect to the axis of the shaft 2, a parallel layer or prepreg S2*b* in which the reinforcing fiber "f" is arranged substantially at an angle of 0° with respect to the axis of the shaft 2, namely substantially in parallel to the axis of the shaft 2, and a perpendicularly crossing layer or prepreg S2*c* in which the reinforcing fiber "f" is arranged substantially at an angle of 90° (at right angles) with respect to the axis of the shaft 2.

The slant layer S2*a* serves mainly to enhance the torsional rigidity of the shaft 2. Therefore, it is preferable to dispose the slant layer S2*a* in at least two layers, especially at least 3 layers, more especially at least 4 layers, and as to the upper limit, in at most 12 layers, especially at most 11 layers, more especially at most 10 layers. It is more preferable that the slant layer S2*a* includes at least two layers of prepregs wherein the reinforcing fibers of one prepreg are inclined in a direction reverse to those of the other prepreg, especially these reinforcing fibers "f" are disposed at angles of +45° and −45°.

The parallel layer S2*b* serves mainly to enhance the flexural rigidity of the shaft 2. Therefore, it is preferable to dispose the parallel layer S2*b* in at least two layers, especially at least three layers, and as to the upper limit, in at most 10 layers, especially at most 9 layers, more especially at most 8 layers.

The perpendicularly crossing layer S2*c* serves mainly to enhance the compressive strength (collapse resistance) of the shaft 2 by crossing the fibers in the slant layers S2*a* and parallel layers S2*b*. If sufficient shaft strength, including compressive strength, is obtained by the slant and parallel layers S2*a* and S2*b*, the use of the layer S2*c* may be omitted. From the viewpoint of suppressing the increase in shaft weight, it is preferable to dispose the layer S2*c* in at most 4 layers, especially at most 3 layers, more especially at most 2 layers.

Further, a butt side prepreg (not shown) may be disposed in a butt side 2*b* portion of the shaft 2.

The flexural rigidity values of respective portions of shaft 2 of the present invention are not particularly limited so long as the average flexural rigidity of the shaft falls within the above-mentioned range. However, it is preferable that the shaft has prescribed flexural rigidity values at the respective measuring locations. For example, in case of a shaft 2 having a length of 850 to 1,150 mm, the flexural rigidity EI is measured at 7 to 10 locations depending on the length of the shaft. If "m" is the number of measuring locations per shaft (in case of a 1,150 mm shaft, m=10) and "n" is variants which are integers of not less than 4 and not more than "m−3" (in case of m=10, n is 4, 5, 6 and 7), the following flexural rigidity values EI(x) are measured in which "x" is an axial distance (mm) from the tip 2*a* of the shaft 2 to the measuring location.

EI(130)
EI(230)
EI(330)
EI(n×100+30)
EI[(m−2)×100+30]
EI[(m−1)×100+30]
EI(m×100+30)

The values of EI(130), EI(230) and EI(330) which are the flexural rigidity of the tip 2*a* portion of the shaft 2 are preferably at least 0.3 kgf·m$^2$, more preferably at least 0.4 kgf·m$^2$, the most preferably at least 0.5 kgf·m$^2$, and are preferably at most 2.0 kgf·m$^2$, more preferably at most 1.8 kgf·m$^2$, the most preferably at most 1.5 kgf·m$^2$. If the flexural rigidity values EI(130) to EI(330) are less than 0.3 kgf·m$^2$, flexure of the tip portion of the shaft 2 becomes very large at impact, so the durability is deteriorated and the direction of the face of club head becomes unstable during the swing to deteriorate the flight direction performance. If the values EI(130) to EI(330) are more than 2.0 kgf·m$^2$, flexure of the tip portion of the shaft 2 is small, so it tends to become difficult to accelerate the head speed prior to impact and further the feel of impact tends to be deteriorated since vibration at impact is conveyed to hands of a player.

The values of EI(n×100+30) which are the flexural rigidity of a middle portion of the shaft 2 are preferably at least 0.5 kgf·m$^2$, more preferably at least 0.7 kgf·m$^2$, the most preferably at least 1.0 kgf·m$^2$, and are preferably at most 5.5 kgf·m$^2$, more preferably at most 5.0 kgf·m$^2$, the most preferably at most 4.0 kgf·m$^2$. If the flexural rigidity values EI(n×100+30) are less than 0.5 kgf·m$^2$, flexure of the middle portion of the shaft 2 during the swing becomes very large, so it tends to be difficult to obtain a good swing rhythm. If the values EI(n×100+30) are more than 5.5 kgf·m$^2$, the flexure of the shaft 2 during the swing is small, so there is a possibility that sufficient increase of head speed is not expected and a power of a player is not effectively conveyed to the club head.

In particular, it is preferable that the EI(n×100+30) values of a middle portion of the shaft 2 are larger than the flexural rigidity of a tip 2*a* side portion of shaft 2 such as EI(130), EI(230) and EI(330). Further, it is preferable that the EI(n×100+30) values gradually increase toward the butt 2*b* of shaft 2.

The values of EI[(m−2)×100+30], EI[(m−1)×100+30] and EI(m×100+30) which are the flexural rigidity of the butt 2*b* portion of the shaft 2 are preferably from 1.5 to 7.0 kgf·m$^2$. If these flexural rigidity values are less than 1.5 kgf·m$^2$, flexure of the shaft during the swing becomes large, so it tends to be difficult to obtain a good swing rhythm. If the values are more than 7.0 kgf·m$^2$, a player will not feel a flexure of the shaft during the swing, so it would be difficult to swing a golf club in good rhythm.

It is preferred that the flexural rigidity of the butt portion of the shaft 2 gradually increases toward the butt 2*b*, as shown by the following relationship:

$$EI[(m-2)\times100+30]<EI[(m-1)\times100+30]<EI(m\times100+30)$$

whereby the flexure on the head 3 side of the shaft is made large so as to serve to accelerate the head speed. In particular, it is preferable that the EI[(m−2)×100+30] value is from 1.5 to 6.0 kgf·m$^2$, the EI[(m−1)×100+30] value is from 1.8 to 6.5 kgf·m$^2$, and the EI(m×100+30) value is from 2.0 to 7.0 kgf·m$^2$.

While the present invention has been described with reference to a wood-type golf club, it goes without saying that the shaft of the present invention is applicable to a iron-type golf club.

The present invention is more specifically described and explained by means of the following examples. It is to be understood that the present invention is not limited to these examples.

Examples 1 to 6 and Comparative Examples 1 and 2

Figure 5:
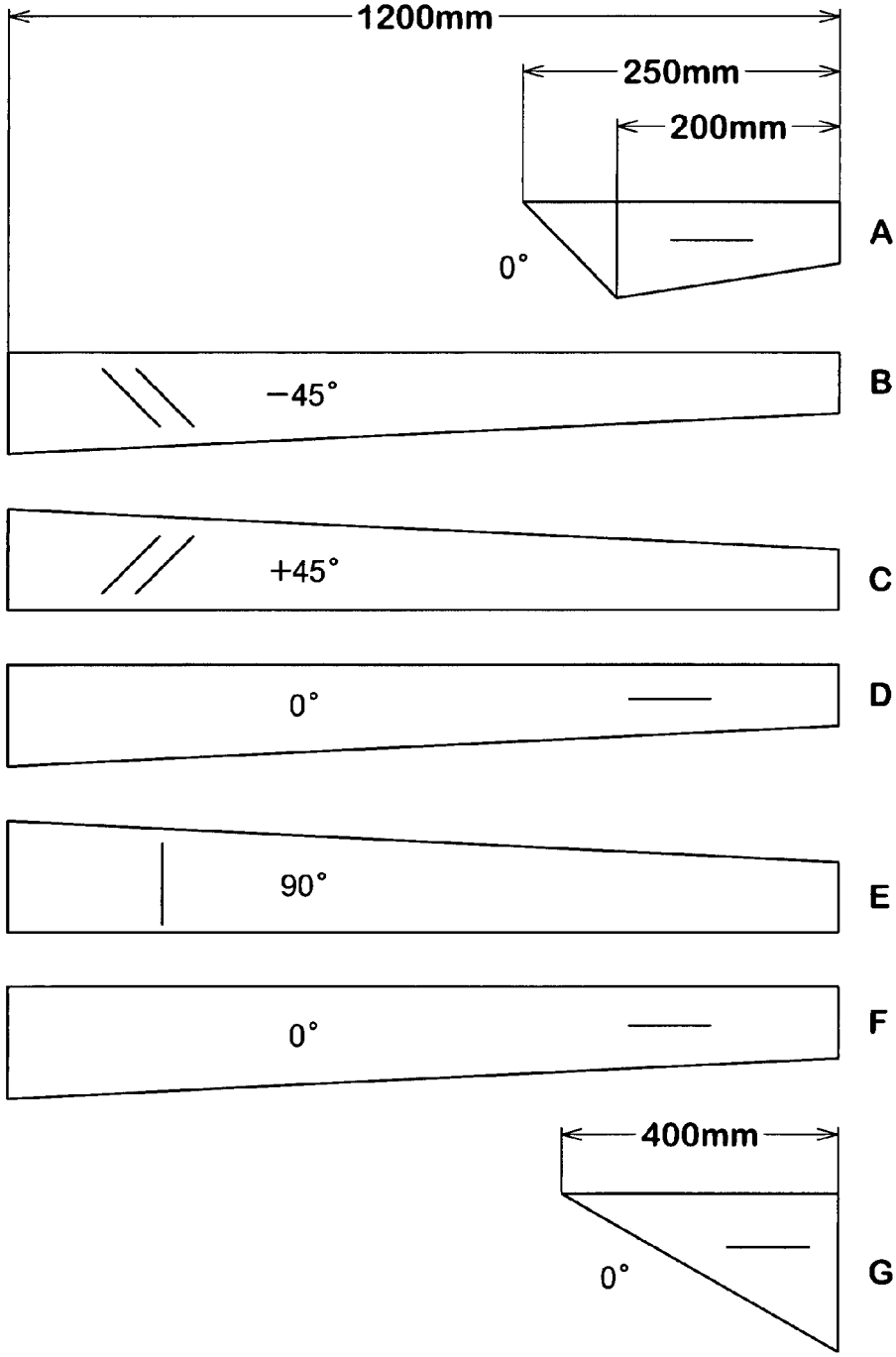
FIG. 5 shows prepregs used to prepare golf club shafts in examples and comparative examples described after.

Golf club shafts were prepared using carbon fiber prepregs having the shapes and sizes shown in FIG. 5 according to the specifications shown in Table 1. The following prepregs were wound around a core in the order of from layer A to layer G and formed. The number of plies of each prepreg to be wound (number of windings) and the tensile modulus of the reinforcing fiber in each prepreg were changed to obtain a desired average flexural rigidity.

Layer A: prepreg 3255G-10: tensile modulus of fiber 24 tons/mm$^2$ (made by Toray Industries, Inc.)
Layer B: prepreg 9255S-10: tensile modulus of fiber 40 tons/mm$^2$ (made by Toray Industries, Inc.)
Layer C: prepreg 9255S-10: tensile modulus of fiber 40 tons/mm$^2$ (made by Toray Industries, Inc.)
Layer D: prepreg 8255S-10: tensile modulus of fiber 30 tons/mm$^2$ (made by Toray Industries, Inc.)
Layer E: prepreg 3255G-10: tensile modulus of fiber 24 tons/mm$^2$ (made by Toray Industries, Inc.)
Layer F: prepreg 805S-3: tensile modulus of fiber 30 tons/mm$^2$ (made by Toray Industries, Inc.)
Layer G: prepreg E1026A-09N: tensile modulus of fiber 10 tons/mm$^2$ (made by Nippon Graphite Fiber Corporation)

To each of the prepared shafts were attached a wood-type golf club head made of a titanium alloy having a loft angle of 11° and a rubber grip to give a wood-type golf club. The obtained golf clubs were tested to evaluate the shafts. The testing methods are as follows:

(1) Head Speed

Each of right-handed ten golfers having a handicap of 0 to 20 and an age of 20 to 40 hit ten golf balls (trade mark "XXIO", product of SRI Sports Limited) with each golf club. The head speed just before hitting a ball was measured by using a laser sensor. The average value of the measured values (10 golfers×10 balls) was obtained for each golf club, and is shown in Table 1 as an index based on the result of Example 1 regarded as 100. The larger the value, the more the head speed is accelerated by flexure of the shaft.

(2) Launch Angle

In the above hitting test for measuring the head speed, the launch angle just after hitting a golf ball was measured by a laser sensor, and the average value of the measured values (10 golfers×10 balls) was obtained for each golf club. The results are shown in Table 1 as an index based on the result of Example 1 regarded as 100. The larger the value, the more suitable the flexure of the shaft is.

(3) Flight Direction Performance

In the above hitting test, the amount of swerve from the target direction to the stop position of the ball was measured for 10 balls, and the standard deviation was obtained. The results are shown in Table 1 as an index based on the result of Example 1 regarded as 100. The smaller the value, the better the direction performance.

(4) Easiness of Swing

The easiness of swing of a golf club was evaluated by feeling of the above 10 golfers according to the following criteria.

5: Very good

4: Good

3: Average

2: Not very good

1: Not good

The test results are shown in Table 1.

TABLE 1

| | Example 1 | | | Example 2 | | | Example 3 | | |
|---|---|---|---|---|---|---|---|---|---|
| | Prepreg | Angle of fiber | No. of plies | Prepreg | Angle of fiber | No. of plies | Prepreg | Angle of fiber | No. of plies |
| Layer A | 3255G-10 | 0° | 4 | 3255G-10 | 0° | 4 | 3255G-10 | 0° | 4 |
| Layer B | 9255S-10 | 45° | 2 | 9255S-10 | 45° | 2 | 9255S-10 | 45° | 2 |
| Layer C | 9255S-10 | −45° | 2 | 9255S-10 | −45° | 2 | 9255S-10 | −45° | 2 |
| Layer D | 3255G-10 | 0° | 1 | 8255S-10 | 0° | 1 | 9255S-10 | 0° | 4 |
| Layer E | 805S-3 | 90° | 1 | 805S-3 | 90° | 1 | 805S-3 | 90° | 1 |
| Layer F | E1026A-09N | 0° | 1 | 3255G-10 | 0° | 1 | 9255S-10 | 0° | 1 |
| Layer G | 3255G-10 | 0° | 2 | 3255G-10 | 0° | 2 | 8255S-10 | 0° | 2 |
| Shaft weight W converted to 46 inch shaft weight (g) | 30 | | | 30 | | | 30 | | |
| Average flexural rigidity EIa (kgf · m$^2$) | 1.5 | | | 3.0 | | | 4.0 | | |
| Lower limit of EIa in equation (1) (kgf · m$^2$) | 1.5 | | | 1.5 | | | 1.5 | | |
| Lower limit of EIa in equation (2) (kgf · m$^2$) | 2.5 | | | 2.5 | | | 2.5 | | |
| Lower limit of EIa in equation (3) (kgf · m$^2$) | 3.0 | | | 3.0 | | | 3.0 | | |
| Head speed (index) | 100 | | | 107 | | | 98 | | |
| Launch angle (index) | 100 | | | 105 | | | 99 | | |
| Flight direction (index) | 100 | | | 88 | | | 105 | | |
| Easiness of swing (five-point rating scale) | 4.7 | | | 4.9 | | | 4.7 | | |

| | Example 4 | | | Example 5 | | | Example 6 | | |
|---|---|---|---|---|---|---|---|---|---|
| | Prepreg | Angle of fiber | No. of plies | Prepreg | Angle of fiber | No. of plies | Prepreg | Angle of fiber | No. of plies |
| Layer A | 3255G-10 | 0° | 4 | 3255G-10 | 0° | 4 | 3255G-10 | 0° | 4 |
| Layer B | 9255S-10 | 45° | 2 | 9255S-10 | 45° | 2 | 9255S-10 | 45° | 2 |
| Layer C | 9255S-10 | −45° | 2 | 9255S-10 | −45° | 2 | 9255S-10 | −45° | 2 |
| Layer D | 3255G-10 | 0° | 4 | 8255S-10 | 0° | 4 | 8255S-10 | 0° | 4 |
| Layer E | 805S-3 | 90° | 1 | 805S-3 | 90° | 1 | 805S-3 | 90° | 1 |
| Layer F | E1026A-09N | 0° | 1 | E1026A-09N | 0° | 1 | 3255S-10 | 0° | 3 |
| Layer G | 3255G-10 | 0° | 2 | 3255G-10 | 0° | 2 | 3255S-10 | 0° | 2 |
| Shaft weight W converted to 46 inch shaft weight (g) | 45 | | | 45 | | | 55 | | |
| Average flexural rigidity EIa (kgf · m$^2$) | 3.0 | | | 4.0 | | | 4.0 | | |
| Lower limit of EIa in equation (1) (kgf · m$^2$) | 3.0 | | | 3.0 | | | 4.0 | | |
| Lower limit of EIa in equation (2) (kgf · m$^2$) | 4.0 | | | 4.0 | | | 5.0 | | |
| Lower limit of EIa in equation (3) (kgf · m$^2$) | 4.0 | | | 4.0 | | | 4.7 | | |
| Head speed (index) | 99 | | | 106 | | | 98 | | |

TABLE 1-continued

| | | | |
|---|---|---|---|
| Launch angle (index) | 98 | 106 | 100 |
| Flight direction (index) | 101 | 86 | 100 |
| Easiness of swing (five-point rating scale) | 4.7 | 4.9 | 4.7 |

| | Comparative Example 1 | | | Comparative Example 2 | | |
|---|---|---|---|---|---|---|
| | Prepreg | Angle of fiber | No. of plies | Prepreg | Angle of fiber | No. of plies |
| Layer A | 3255G-10 | 0° | 4 | 3255G-10 | 0° | 4 |
| Layer B | 9255S-10 | 45° | 2 | 9255S-10 | 45° | 2 |
| Layer C | 9255S-10 | −45° | 2 | 9255S-10 | −45° | 2 |
| Layer D | 3255G-10 | 0° | 3 | 3255S-10 | 0° | 6 |
| Layer E | 805S-3 | 90° | 1 | 805S-3 | 90° | 1 |
| Layer F | E1026A-09N | 0° | 2 | E1026A-09N | 0° | 2 |
| Layer G | 3255G-10 | 0° | 2 | 3255G-10 | 0° | 2 |
| Shaft weight W converted to 46 inch shaft weight (g) | 45 | | | 60 | | |
| Average flexural rigidity EIa (kgf · m$^2$) | 2.5 | | | 3.5 | | |
| Lower limit of EIa in equation (1) (kgf · m$^2$) | 3.0 | | | 4.5 | | |
| Lower limit of EIa in equation (2) (kgf · m$^2$) | 4.0 | | | 5.5 | | |
| Lower limit of EIa in equation (3) (kgf · m$^2$) | 4.0 | | | 5.0 | | |
| Head speed (index) | 96 | | | 94 | | |
| Launch angle (index) | 88 | | | 84 | | |
| Flight direction (index) | 173 | | | 226 | | |
| Easiness of swing (five-point rating scale) | 3.5 | | | 3.1 | | |

From the results shown in Table 1, it is confirmed that golf clubs having the shafts of the present invention can be swung at high head speed and have excellent flight distance and flight direction performances.

What is claimed is:

1. A golf club shaft comprising a fiber-reinforced resin, the shaft having an actual length SL falling within the range of 800 to 1,200 mm and an actual weight Wr according to the equation W=Wr×46×25.4/SL, wherein W is at least 30 g and said shaft has an average flexural rigidity EIa of at most 4.0 kgf·m$^2$, said shaft satisfies the following equation:

$$EIa \geqq 0.1W - 0.5$$

and said shaft has a flexural rigidity EI(330) of 0.3 to 1.8 kgf·m$^2$ in which EI(330) denotes a flexural rigidity measured at a distance of 330 mm from the head side tip of the shaft.

2. The golf club comprising the golf club shaft of claim 1, and a golf club head attached to said shaft.

3. The shaft of claim 1, wherein said shaft has a length of 800 to 1,150 mm.

4. The shaft of claim 1, wherein said shaft has a weight W of 30 to 40 g calculated as a shaft having a length of 46 inches, and satisfies the equation:

$$EIa \leqq 0.1W.$$

5. The shaft of claim 1, wherein said shaft is made of only a fiber-reinforced resin consisting essentially of a reinforcing fiber and a resin consisting of a thermosetting resin.

6. The shaft of claim 5, wherein said thermo setting resin is a member selected from the group consisting of an epoxy resin, an unsaturated polyester resin, a phenol resin, a melamine resin, a urea resin, a diallyl phthalate resin, a polyurethane resin, a polyimide resin, and a silicone resin.

7. The shaft of claim 5, wherein said thermosetting resin is an epoxy resin.

8. The shaft of claim 1, wherein said shaft is made of only a fiber-reinforced resin consisting essentially of a reinforcing fiber and a resin selected from a thermosetting resin and a thermoplastic resin.

9. The shaft of claim 8, wherein said thermosetting resin is a member selected from the group consisting of an epoxy resin, an unsaturated polyester resin, a phenol resin, a melamine resin, a urea resin, a diallyl phthalate resin, a polyurethane resin, a polyimide resin, and a silicone resin, and said thermoplastic resin is a member selected from the group consisting of a polyamide resin, a saturated polyester resin, a polycarbonate resin, a polystyrene resin, a polyethylene resin, a polyvinyl acetate resin, an AS resin, a methacrylic resin, a polypropylene resin, and a fluorine-containing resin.

10. The shaft of claim 1, wherein said shaft is prepared by forming plural kinds of prepregs into a cylindrical laminate and curing it, in which said prepregs consists of full length prepregs constituting the full length of said shaft and at least one small sheet-like tip side prepreg laminated on a tip side portion of said shaft.

* * * * *